US006347661B2

(12) United States Patent
Miki

(10) Patent No.: US 6,347,661 B2
(45) **Date of Patent: *Feb. 19, 2002**

(54) COOLING/HEATING APPARATUS FOR SEMICONDUCTOR PROCESSING LIQUID

(75) Inventor: Hiroyuki Miki, Ibaraki (JP)

(73) Assignee: SMC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,875

(22) Filed: Apr. 19, 1999

(30) Foreign Application Priority Data

May 27, 1998 (JP) ..... 10-145439

(51) Int. Cl.[7] ..... F28F 7/00

(52) U.S. Cl. ..... 165/80.4; 165/185; 165/133; 165/905; 165/80.2; 165/134.1; 257/714; 361/699; 361/705; 361/708

(58) Field of Search ..... 165/185, 905, 165/133, 134.1–135, 80.4, 80.1–80.2; 257/714; 361/689, 699, 704, 705, 708

(56) References Cited

U.S. PATENT DOCUMENTS

| | | | | | |
|---|---|---|---|---|---|
| 4,139,051 | A | * | 2/1979 | Jones et al. | 165/80.1 |
| 4,461,347 | A | * | 7/1984 | Layton et al. | 165/133 |
| 4,849,858 | A | * | 7/1989 | Grapes et al. | 165/905 X |
| 5,181,562 | A | * | 1/1993 | Kuriki | 165/905 X |
| 5,211,220 | A | * | 5/1993 | Swozil et al. | 165/905 X |
| 6,050,331 | A | * | 4/2000 | Breault et al. | 165/905 X |

FOREIGN PATENT DOCUMENTS

| | | |
|---|---|---|
| EP | 0 203 213 | 12/1986 |
| JP | 5-332696 | 12/1993 |
| JP | 6-291104 | 10/1994 |
| JP | 9-199472 | 7/1997 |
| JP | 9-229587 | 9/1997 |
| JP | 9-313926 | 12/1997 |

* cited by examiner

*Primary Examiner*—Christopher Atkinson
(74) *Attorney, Agent, or Firm*—Oblon, Spivak, McClelland, Maier & Neustadt, P.C.

(57) ABSTRACT

In order to provide a cooling/heating apparatus for a semiconductor processing liquid being highly resistant to corrosive chemicals and free from elution of harmful impurities, a heat exchanging substrate 3 is formed by heat-depositing a fluorine-contained resin sheet 3B to a processing liquid contact surface of a graphite substrate 3A.

1 Claim, 3 Drawing Sheets

COOLING/HEATING APPARATUS FOR SEMICONDUCTOR PROCESSING LIQUID

FIELD OF THE INVENTION

The present invention relates to a cooling/heating apparatus for a semiconductor processing liquid applied to a cooling/heating unit of a thermoregulator used to control temperature of semiconductor processing corrosive chemicals.

PRIOR ART

In a cooling/heating apparatus for a semiconductor processing liquid having heat exchanging substrates to cool or heat a corrosive semiconductor processing liquid so as to keep the liquid at a designated temperature, most of the heat exchanging substrates used are generally configured such that a sheet of fluorine-contained resin (for which the trade name is TEFLON) etched with plasma or sodium is joined by the medium of an adhesive layer of epoxy resin or other adhesives to a processing liquid contact surface side of a stainless steel plate or a graphite substrate. In the case of these conventional heat exchanging substrates, however, when highly corrosive chemicals are cooled or heated, the chemicals, even though slightly, infiltrate through the fluorine-contained resin sheet, which may cause the adhesive to be dissolved out of the adhesive layer between the stainless steel plate or the graphite substrate and the sheet. Particularly, when using a stainless steel plate, the stainless steel is attacked by the chemicals as the adhesive is dissolved out and a metallic ion may subsequently be dissolved in the chemicals as an impurity. Also, in either case, there is a problem pointed out that chemicals applicable can be limited depending on thermal resistance of adhesives.

SUMMARY OF THE INVENTION

It is therefore an object of the present invention to provide a cooling/heating apparatus for a semiconductor processing liquid having heat exchanging substrates which is highly resistant to corrosive chemicals and is free from elution of harmful impurities such as a heavy metal ion.

To achieve the above object, according to a first embodiment of the present invention, there is provided a cooling/heating apparatus for a semiconductor processing liquid to cool or heat by allowing heat exchanging substrates to contact the semiconductor processing liquid, wherein the heat exchanging substrates are formed by heat-depositing a fluorine-contained resin sheet to a processing liquid contact surface of a graphite substrate.

Also, according to a second embodiment of the present invention, there is provided a cooling/heating apparatus for a semiconductor processing liquid, wherein heat exchanging substrates are formed by providing an amorphous carbon layer over a processing liquid contact surface of a graphite substrate and heat-depositing a fluorine-contained resin sheet to the amorphous carbon layer.

Furthermore, according to a third embodiment of the present invention, there is provided a cooling/heating apparatus for a semiconductor processing liquid, wherein heat exchanging substrates are formed by heat-depositing a fluorine-contained resin sheet to a processing liquid contact surface of a vitrified carbon substrate.

According to a fourth embodiment of the present invention, there is provided a cooling/heating apparatus for a semiconductor processing liquid, wherein the heat exchanging substrates are formed by heat-depositing a fluorine-contained resin sheet to a processing liquid contact surface of a silicon carbide substrate.

According to a fifth embodiment of the present invention, there is provided a cooling/heating apparatus for a semiconductor processing liquid, wherein the heat exchanging substrates are formed by providing a silicon carbide layer over a processing liquid contact surface of a graphite substrate and heat-depositing a fluorine-contained resin sheet to the silicon carbide layer.

In the cooling/heating apparatus for a semiconductor processing liquid of the present invention having the above construction, heat exchanging substrates are formed either by directly heat-depositing a fluorine-contained resin sheet to a processing liquid contact surface of a graphite substrate which is highly resistant to corrosive chemicals, a vitrified carbon substrate or a silicon carbide substrate, or by providing an amorphous carbon layer over a processing liquid contact surface of a graphite substrate or a silicon carbide substrate and directly heat-depositing a fluorine-contained resin sheet to the amorphous carbon layer so that the apparatus is free from elution of harmful impurities caused by the attachment of the chemicals to the adhesive layer, and moreover, elution of harmful impurities such as a heavy-metal ion caused by corrosion of the substrate itself is prevented as well.

DESCRIPTION OF THE PREFERRED EMBODIMENTS

Figure 1:
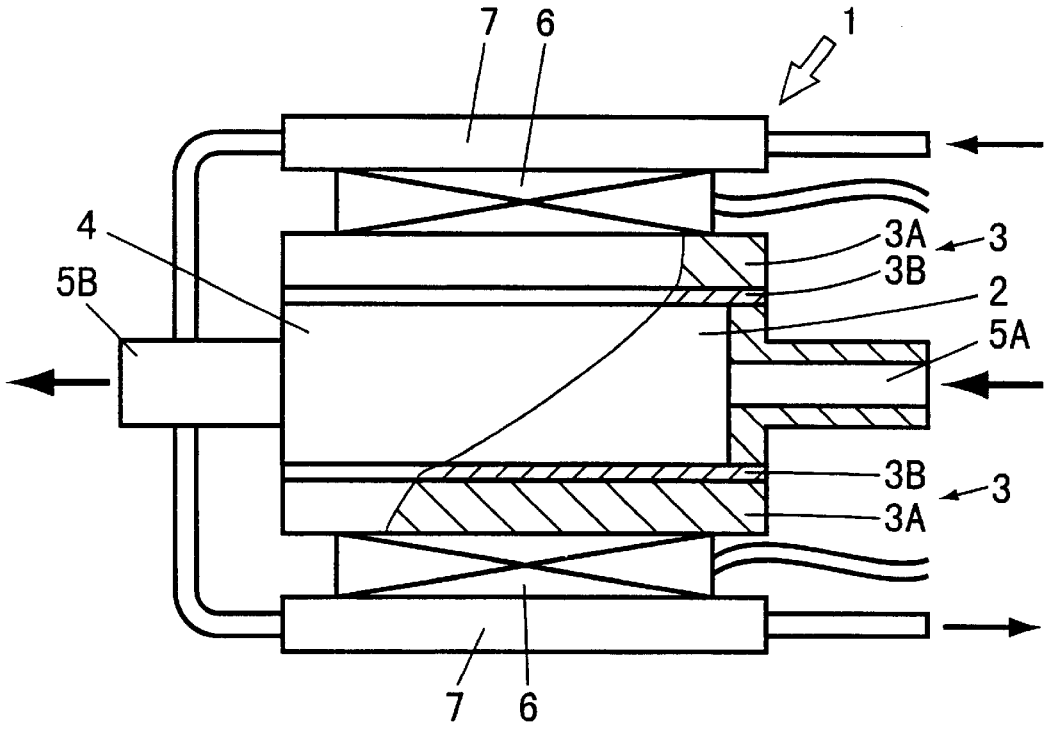
FIG. 1 is a partly sectional side view of a cooling/heating apparatus for a semiconductor processing liquid of the present invention.

FIG. 1 shows a first embodiment of a cooling/heating apparatus for a semiconductor processing liquid according to the present invention. The cooling/heating apparatus 1 is used for controlling temperature of corrosive chemicals such as semiconductor processing liquids. To be brief, as shown in FIG. 1, the temperature of the above semiconductor processing liquid is controlled in such a manner that the semiconductor processing liquid taken out of a chemical container (not shown) is guided into a cooling/heating chamber 2 through a tube 5A made of highly corrosion-resistant fluorine-contained resin, wherein heat exchanging substrates 3 are placed in opposed positions.

As shown in FIG. 1, the cooling/heating chamber 2 is constructed such that the heat exchanging substrates 3 (see FIG. 2) formed by heat-depositing a fluorine-contained resin sheet 3B to a processing liquid contact surface of a graphite substrate 3A are placed in opposed positions being separated by a sidewall 4 formed of fluorine-contained resin, and opening ends on both sides thereof are connected with tubes 5A, 5B at inlet and outlet sides of the semiconductor processing liquid made from fluorine-contained resin.

Further, thermo-modules 6 for cooling or heating the semiconductor processing liquid are each tightly secured to the outer sidewall of the respective heat exchanging substrates 3, 3 in the cooling/heating chamber 1 with the heat exchanging substrates 3 therebetween. When cooling the semiconductor processing liquid, heat slingers 7 for promoting heat release of the thermomodules 6 are tightly secured to the thermomodules 6 respectively by way of introducing cooling water through a cooling pipe.

As the thermomodules 6, semiconductor thermionic elements capable of heating and cooling by way of changing the polarity of an applied voltage, such as Peltier element, are preferably used.

In the cooling/heating apparatus for a semiconductor processing liquid 1 having the above construction, the semiconductor processing liquid is introduced into the cooling/heating chamber 2 through the tube 5A and cooled or heated to a predetermined temperature in the cooling/heating chamber 2. As the heat exchanging substrates 3 are formed by heat-depositing the fluorine-contained resin sheet 3B to a highly corrosion-resistant graphite substrate 3A, the substrates 3 are free from elution of harmful impurities even if a corrosive semiconductor processing liquid infiltrates into the fluorine-contained resin sheet 3B. Furthermore, since adhesives are not used for contact surfaces of the graphite substrate 3A and the fluorine-contained resin sheet 3B, the heat exchanging substrates 3 can be heated, without depending on a heat resistant temperature of the adhesive, to a heat resistant temperature of the fluorine-contained resin sheet 3B with which the semiconductor processing liquid contacts.

The semiconductor processing liquid maintained at a constant temperature in the cooling/heating chamber 2 is discharged through a tube 5B.

Thus, according to the cooling/heating apparatus for a semiconductor processing liquid 1, the heat exchanging substrates 3 comprise only the highly corrosion-resistant graphite and the fluorine-contained resin so that the heat exchanging substrates 3 are free from elution of harmful impurities caused by the attack of the chemicals such as semiconductor processing liquids to the adhesive layer and, moreover, elution of harmful impurities caused by corrosion of the substrate 3 itself is prevented as well.

For the heat exchanging substrates 3 making up the cooling/heating chamber 2 in the cooling/heating apparatus 1, a structure shown in FIGS. 3 through 6 can also be adopted.

Figure 3:
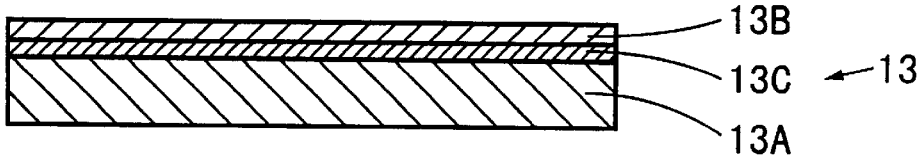
FIG. 3 is an enlarged side sectional view of a heat exchanging substrate showing another construction.

First, a heat exchanging substrate 13 shown in FIG. 3 is formed in such a manner that an amorphous carbon layer 13C is formed by heat treating a processing liquid contact surface of a graphite substrate 13A, and a fluorine-contained resin sheet 13B is heat-deposited to the amorphous carbon layer 13C.

Figure 4:
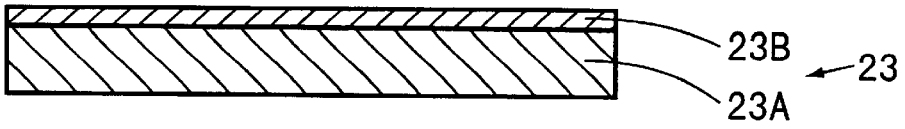
FIG. 4 is an enlarged side sectional view of a heat exchanging substrate showing still another construction.

Also, a heat exchanging substrate 23 shown in FIG. 4 is formed by directly heat-depositing a fluorine-contained resin sheet 23B to a processing liquid contact surface of a vitrified carbon substrate 23 A.

Figure 5:
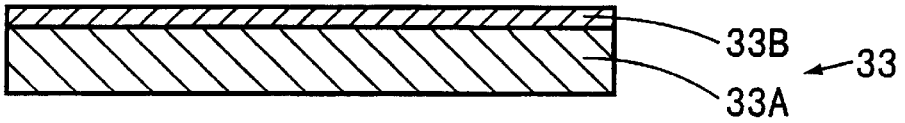
FIG. 5 is an enlarged side sectional view of a heat exchanging substrate showing still another construction.

Furthermore, a heat exchanging substrate 33 shown in FIG. 5 is formed by directly heat-depositing a fluorine-contained resin sheet 33B to a processing liquid contact surface of a silicon carbide substrate 33A.

Figure 6:
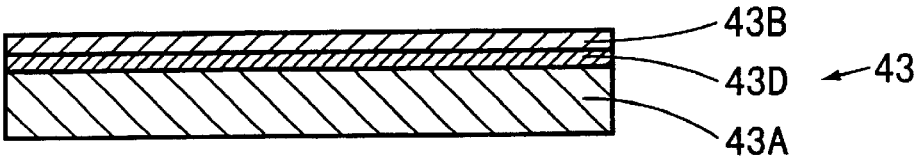
FIG. 6 is an enlarged side sectional view of a heat exchanging substrate showing still another construction.

A heat exchanging substrate 43 shown in FIG. 6 is formed by providing a silicon carbide layer 43D on a processing liquid contact surface of a graphite substrate 43A, and directly heat-depositing a fluorine-contained resin sheet 43B to the silicon carbide layer 43D.

Figure 2:
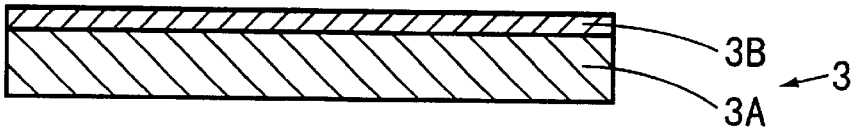
FIG. 2 is an enlarged side sectional view of a heat exchanging substrate.

Because other configurations and operations of the heat exchanging substrates shown in the FIGS. 2 through 6 are substantially the same as those of the heat exchanging substrate 3 in the cooling/heating chamber 2 of the cooling/heating apparatus 1 described in FIGS. 1 and 2, the explanation for them is omitted.

As was described above in detail, according to the cooling/heating apparatus for a semiconductor processing liquid of the present invention, a heat exchanging substrate is constructed such that a fluorine-contained resin sheet is directly heat-deposited to a processing liquid contact surface side of a highly corrosion-resistant graphite substrate, a vitrified carbon substrate or a silicon carbide substrate, which makes it possible for the heat exchanging substrate to be free from elution of harmful impurities through corrosion of an adhesive layer attacked by chemicals, and furthermore, elution of impurities caused by corrosion of the substrate itself is prevented.

What is claimed is:

1. A cooling/heating apparatus for a semiconductor processing liquid, comprising one or more heat exchanging substrates, wherein said heat exchanging substrates each comprise:

a graphite substrate;

an amorphous carbon layer in direct contact with said graphite substrate; and a fluorine resin-containing layer directly coated on the entire surface of said amorphous carbon layer without any intervening adhesive;

wherein said fluorine resin-containing layer is formed by heat-depositing a fluorine-containing resin onto said amorphous carbon layer without any adhesive.

* * * * *